US009441180B2

(12) United States Patent
Preston et al.

(10) Patent No.: US 9,441,180 B2
(45) Date of Patent: Sep. 13, 2016

(54) ANTHRANILIC ESTERS AS ADDITIVES IN LUBRICANTS

(75) Inventors: Adam J. Preston, Willoughby, OH (US); Matthew D. Gieselman, Wickliffe, OH (US); Virginia A. Carrick, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 119 days.

(21) Appl. No.: 13/256,335

(22) PCT Filed: Mar. 17, 2010

(86) PCT No.: PCT/US2010/027621

§ 371 (c)(1),
(2), (4) Date: Oct. 27, 2011

(87) PCT Pub. No.: WO2010/107882

PCT Pub. Date: Sep. 23, 2010

(65) Prior Publication Data

US 2012/0040876 A1 Feb. 16, 2012

Related U.S. Application Data

(60) Provisional application No. 61/161,775, filed on Mar. 20, 2009.

(51) Int. Cl.

| | |
|---|---|
| ***C10M 135/14*** | (2006.01) |
| ***C10M 129/70*** | (2006.01) |
| ***C10M 133/12*** | (2006.01) |
| ***C10M 135/12*** | (2006.01) |

(52) U.S. Cl.

CPC ..... *C10M 135/14* (2013.01); *C10M 129/70* (2013.01); *C10M 133/12* (2013.01); *C10M 135/12* (2013.01); *C10M 2203/1025* (2013.01); *C10M 2205/022* (2013.01); *C10M 2207/284* (2013.01); *C10M 2215/04* (2013.01); *C10M 2215/06* (2013.01); *C10M 2215/066* (2013.01); *C10M 2215/08* (2013.01); *C10M 2215/22* (2013.01); *C10M 2215/224* (2013.01); *C10M 2215/28* (2013.01); *C10M 2219/06* (2013.01); *C10M 2219/062* (2013.01); *C10M 2223/045* (2013.01); *C10N 2230/36* (2013.01); *C10N 2230/42* (2013.01); *C10N 2230/43* (2013.01); *C10N 2230/45* (2013.01); *C10N 2230/52* (2013.01); *C10N 2240/10* (2013.01)

(58) Field of Classification Search

CPC ..... C10M 129/70; C10M 133/12; C10M 135/12; C10M 135/14; C10M 2205/022; C10M 2207/284; C10M 2215/04; C10M 2215/06; C10M 2215/066; C10M 2215/08; C10M 2215/22; C10M 2215/224; C10M 2215/28; C10M 2219/06; C10M 2219/062; C10M 2223/045; C10N 2230/36; C10N 2230/42; C10N 2230/43; C10N 2230/45; C10N 2230/52; C10N 2240/10

USPC ..... 508/500, 545

See application file for complete search history.

(56) References Cited

U.S. PATENT DOCUMENTS

| | | | | |
|---|---|---|---|---|
| 2,390,943 | A | 12/1945 | Kavanagh et al. | |
| 3,642,632 | A * | 2/1972 | Coburn et al. | 508/500 |
| 4,021,470 | A | 5/1977 | Braid | |
| 4,938,880 | A * | 7/1990 | Waddoups et al. | 508/192 |
| 2003/0153471 | A1* | 8/2003 | Godici et al. | 508/479 |
| 2006/0247140 | A1 | 11/2006 | Cressey et al. | |
| 2007/0203031 | A1 | 8/2007 | Bardasz et al. | |

FOREIGN PATENT DOCUMENTS

| | | |
|---|---|---|
| EP | 0391649 | 10/1990 |

OTHER PUBLICATIONS

Corresponding PCT Publication and Search Report. No. WO 2010/107882 A1 published Sep. 23, 2010.

Written Opinion from corresponding international appln. No. PCT/US2010/027621 mailed Jun. 2, 2010.

* cited by examiner

*Primary Examiner* — James Goloboy

(74) *Attorney, Agent, or Firm* — Michele M. Tyrpak; Teresan W. Gilbert; Christopher D. Hilker

(57) ABSTRACT

This invention relates to anthranilate esters and their use in lubricants, such as engine oils. The invention particularly relates to compositions that deliver an ash-free base to a lubricant in the form of a basic amine additive, without adversely impacting seal compatibility and/or degradation, and methods thereof.

9 Claims, No Drawings

ANTHRANILIC ESTERS AS ADDITIVES IN LUBRICANTS

FIELD OF THE INVENTION

The invention relates to anthranilate esters and similar materials and their use in lubricants, such as engine oils. The invention particularly relates to delivering a basic amine to a lubricant while reducing and/or limiting detrimental effects commonly associated with basic amine additive containing lubricants, such as poor seal compatibility.

BACKGROUND OF THE INVENTION

It is known that lubricants become less effective during their use due to exposure to the operating conditions of the device they are used in, and particularly due to exposure to by-products generated by the operation of the device. For example, engine oil becomes less effective during its use, in part due to exposure of the oil to acidic and pro-oxidant byproducts. These byproducts result from the incomplete combustion of fuel in devices such as internal combustion engines, which utilize the oil. These byproducts lead to deleterious effects in the engine oil, and so, on the engine as well. The byproducts can oxidize hydrocarbons found in the lubricating oil, yielding carboxylic acids and other oxygenates. These oxidized and acidic hydrocarbons can then go on to cause corrosion, wear and deposit problems.

Base containing additives are added to lubricants in order to neutralize such byproducts, thus reducing the harm they cause to the lubricant, such as an engine oil, and so to the device, such as an engine. Over-based calcium or magnesium carbonate detergents have been used for some time as acid scavengers, neutralizing these byproducts and so protecting both the lubricant and the device. However, over-based phenate and sulfonate detergents carry with them an abundance of metal as measured by sulfated ash. New industry upgrades for diesel and passenger car lubricating oils are putting ever decreasing limits on the amount of sulfated ash, and by extension the amount of over-based detergent, permissible in an oil. A source of base that consists of only N, C, H, and O is extremely desirable.

Basic amine additives are an alternative to ash containing over-based metal detergents, in particular alkyl and aromatic amines. However, the addition of basic amine additives can lead to additional detrimental effects. For example, it is known that alkyl and some aromatic amines degrade fluoroelastomeric seals materials. These basic amine additives, such as succinimide dispersants, contain polyamine headgroups, which provide the source of base to the oil. However, such amines are believed to cause dehydrofluorination in fluoroelastomeric seals materials, such as Viton seals. This is a first step in seals degradation. Seal degradation leads to seal failure, such as seal leaks, which harms engine performance and also can cause engine damage. Generally, the base content, or total base number (TBN), of a lubricant can only be boosted modestly by such a basic amine before seals degradation becomes a significant issue, limiting the amount of TBN that can be provided by such additives.

There is a need for additives that deliver ash-free base to a lubricant without causing detrimental effects. In particular, there is need for basic amine additives that deliver ash-free base to engine oil without increasing seals degradation and/or impairing seal compatibility.

U.S. Pat. No. 2,390,943 relates to compositions comprising hydrocarbon oil and a combination of stabilizing ingredients.

U.S. Pat. Nos. 2,369,090 and 3,856,690 relate to lubricants which are stabilized against oxidative degradation.

U.S. Pat. No. 3,642,632 relates to lubricant compositions having improved resistance to deterioration under high performance conditions and is focused on gas turbine engines, such as turbojet, turboprop and turbofan engines.

It has now been discovered that anthranilate esters may be added to lubricants, such as engine oil, to deliver base. These anthranilate esters surprisingly do not cause the harm to seal performance one skilled in the art would expect from such basic amine additives.

SUMMARY OF THE INVENTION

The present invention relates to anthranilate esters which may be used as lubricant additives. The additives of the present invention are basic amines that supply base to a lubricant without causing harm to seal performance. The present invention also relates to a method for neutralizing harmful acids with anthranilate ester derivatives as demonstrated by their ability to boost the TBN of fully formulated engine oils. It is known to those skilled in the art that some alkyl and aromatic amines degrade fluoroelastomeric seals material. Surprisingly, the basic amines of the current invention cause little to no harm to the seals material.

The invention provides a lubricating composition comprising (a) an oil of lubricating viscosity and (b) an additive of formula (I)

(I)

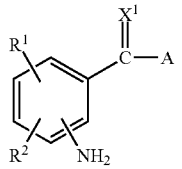

wherein $X^1$ is oxygen or sulfur; A is $—X^2—R^3$ or $—R^3$ where $X^2$ is oxygen or sulfur and $R^3$ is a hydrocarbyl group; $R^1$ and $R^2$ are each independently hydrogen or a hydrocarbon group, or where $R^1$ and $R^2$ are linked forming a hydrocarbyl ring The invention provides for compositions containing the additive described herein, and optionally further comprising another detergent, where the TBN of the overall composition and/or the TBN delivered to the composition from the additive and the optional detergent, is greater than 6. The invention also provides for the use of the additive described herein as a TBN booster such that its addition boosts the TBN of the lubricating composition to which it is added by at least 1 mg KOH/g.

The invention also provides for any of the compositions described herein, where the hydrocarbyl group contained within the A group in formula (I), (II) or (III) is: a hydrocarbyl group containing at least 10 carbon atoms; a hydrocarbyl group containing at least one branch point; a fully saturated alkyl group; or combinations thereof.

The invention also provides for a method for preparing a lubricating composition comprising combining the components described above as well as a method of lubricating an internal combustion engine, comprising supplying to the engine the lubricating composition described above.

DETAILED DESCRIPTION

Various preferred features and embodiments will be described below by way of non-limiting illustration.

The Oil of Lubricating Viscosity

One component which is used in certain embodiments of the disclosed technology is an oil of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition.

Natural oils useful in making the inventive lubricants and functional fluids include animal oils and vegetable oils as well as mineral lubricating oils such as liquid petroleum oils and solvent-treated or acid-treated mineral lubricating oils of the paraffinic, naphthenic or mixed paraffinic/-naphthenic types which may be further refined by hydrocracking and hydrofinishing processes.

Synthetic lubricating oils include hydrocarbon oils and halo-substituted hydrocarbon oils such as polymerized and interpolymerized olefins, also known as polyalphaolefins; polyphenyls; alkylated diphenyl ethers; alkyl- or dialkylbenzenes; and alkylated diphenyl sulfides; and the derivatives, analogs and homologues thereof. Also included are alkylene oxide polymers and interpolymers and derivatives thereof, in which the terminal hydroxyl groups may have been modified by esterification or etherification. Also included are esters of dicarboxylic acids with a variety of alcohols, or esters made from C5 to C12 monocarboxylic acids and polyols or polyol ethers. Other synthetic oils include silicon-based oils, liquid esters of phosphorus-containing acids, and polymeric tetrahydrofurans.

Unrefined, refined and re-refined oils, either natural or synthetic, can be used in the lubricants of the present invention. Unrefined oils are those obtained directly from a natural or synthetic source without further purification treatment. Refined oils have been further treated in one or more purification steps to improve one or more properties. They can, for example, be hydrogenated, resulting in oils of improved stability against oxidation.

In one embodiment, the oil of lubricating viscosity is an API Group I, Group II, Group III, Group IV, or Group V oil, including a synthetic oil, or mixtures thereof. In another embodiment, the oil is Groups II, III, IV, or V. These are classifications established by the API Base Oil Interchangeability Guidelines. Group III oils contain <0.03 percent sulfur and >90 percent saturates and have a viscosity index of >120. Group II oils have a viscosity index of 80 to 120 and contain <0.03 percent sulfur and >90 percent saturates. Polyalphaolefins are categorized as Group IV. The oil can also be derived from the hydroisomerization of wax, such as slack wax or a Fischer-Tropsch synthesized wax. Such "Gas-to-Liquid" oils are typically characterized as Group III. Group V encompasses "all others".

In one embodiment, at least 50% by weight of the oil of lubricating viscosity is a polyalphaolefin (PAO). Typically, the polyalphaolefins are derived from monomers having from 4 to 30, or from 4 to 20, or from 6 to 16 carbon atoms. Examples of useful PAOs include those derived from 1-decene. These PAOs may have a viscosity of 1.5 to 150 $mm^2/s$ (cSt) at 100° C. PAOs are typically hydrogenated materials.

The oils of the present technology can encompass oils of a single viscosity range or a mixture of high viscosity range oils and low viscosity range oils. In one embodiment, the oil exhibits a 100° C. kinematic viscosity of 1 or 2 to 8 or 10 $mm^2/sec$ (cSt). The overall lubricant composition may be formulated using oil and other components such that the lubricant composition's viscosity at 100° C. is 1 or 1.5 to 10 or 15 or 20 $mm^2/sec$ and the Brookfield viscosity (ASTM-D-2983) at −40° C. is less than 20 or 15 Pa-s (20,000 cP or 15,000 cP), such as less than 10 Pa-s, even 5 or less.

In some embodiments, the compositions of the present invention have a phosphorus content below 0.2 percent by weight, a sulfur content equal to or below 1.0 percent by weight, and a sulfated ash content equal to or below 1.5 percent by weight, or some combination thereof. In some of these embodiments, the phosphorus content may be equal to or less than 0.15 or 0.12 or 0.1 percent by weight, the sulfur content may be equal to or less than 0.8 or 0.5 or 0.4 percent by weight, the sulfated ash content may be equal to or less than 1.3 or 1.0 or 0.5 percent by weight, or some combination thereof. In such embodiments the phosphorus content may be 0.1 or 0.08 or 0.06 percent by weight, or may be 0.02 to 0.06 or 0.08 percent by weight.

The Anthranilate Esters

The present invention relates to anthranilate esters and similar additives, all of which are referred to herein as anthranilate esters. These additives may be used as lubricant additives and include those described by Formula (I):

(I)

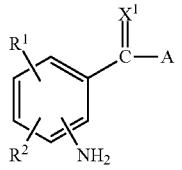

wherein $X^1$ is oxygen or sulfur; A is $—X^2—R^3$ or $—R^3$ where $X^2$ is oxygen or sulfur and $R^3$ is a hydrocarbyl group; $R^1$ and $R^2$ are each independently hydrogen or a hydrocarbon group, or where $R^1$ and $R^2$ are linked forming a hydrocarbyl ring In some embodiments the additive may be represented by Formula (II):

(II)

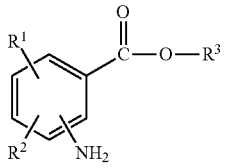

wherein $R^1$, $R^2$ and $R^3$ are each independently hydrogen or a hydrocarbon group, or where $R^1$ and $R^2$ are linked forming a hydrocarbyl ring and where $R^3$ is hydrogen or a hydrocarbon group.

In some of these embodiments, the amine group shown in Formula (II) or Formula (III) may be in the ortho or para position. In some embodiments, the additive of the present invention has the amine group in the ortho position.

In some embodiments the additive may be represented by Formula (III):

(III)

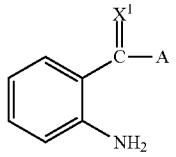

wherein $X^1$ is oxygen or sulfur; A is —$X^2$—$R^3$ or —$R^3$ where $X^2$ is oxygen or sulfur and $R^3$ is a hydrocarbyl group.

In any of the embodiments above, $R^3$ may be a hydrocarbyl group containing at least 10 carbon atoms, at least 12 carbon atoms, or at least 13 carbon atoms. The hydrocarbyl group $R^3$ may also contain one or more branch points, and in some embodiments may contain at least 2 branch points or at least 3 or 4 branch points. In other embodiments the hydrocarbyl group $R^3$ is a fully saturated alkyl group. In still other embodiments, the hydrocarbyl group $R^3$ possesses a combination of at least two of the features discussed in this paragraph.

In other embodiments, the anthranilate ester may be described as the reaction product of an alcohol and a hetero bicyclic aromatic compound consisting of a nitrogen-containing ring and an aromatic ring, where the nitrogen-containing ring has groups at the 2 and 4 positions, and where the ring also contains an additional oxygen atom, typically in between the groups. The aromatic ring may have up to four substituent groups attached to the carbon atoms in the ring. These substituent groups may be hydrocarbyl groups. In one embodiment there are no substituent groups on the aromatic ring. A suitable hetero bicyclic aromatic compound is isatoic anhydride. In some embodiments the anthranilate ester additive of the present invention, as described by any of the formulas above, is derived from isatoic anhydride.

The reaction of the alcohol and the hetero bicyclic aromatic compound may be carried out in the presence of a basic catalyst, such as NaOH.

Suitable alcohols may be described by the formula $R^3$—OH where $R^3$ is a hydrocarbyl group as defined above. In some embodiments the alcohol and/or the $R^3$ group in the alcohol is chosen to impart oil solubility to the ester product.

In some embodiments the alcohol used to prepare the anthranilate ester additive is: a mixture of linear alcohols where the alcohols may contain 1 to 4, 2 to 10, 3 to 6, or 8 to 10 carbon atoms. In some embodiments the alcohol used to prepare the additive is: decyl alcohol; tridecyl alcohol, optionally with one or more branch points such as isotridecyl alcohol and 2,4,6,8-tetramethyl-nonanol; 2-ethylhexanol; or combinations thereof. In other embodiments, the alcohol used may contain 1-24, 2 to 18, 4 to 14 or 6 to 12 carbon atoms and any of the alcohols listed herein may be used in combination with one another.

In some embodiments the alcohol used to prepare the anthranilate ester additive is: 2,4,6,8-tetramethyl-nonanol, a mixture of linear alcohols where the alcohols may contain 8 to 10 carbon atoms, 2-ethylhexanol, or combinations thereof. In still other embodiments, the alcohol used is 2,4,6,8-tetramethyl-nonanol, a mixture of linear alcohols where the alcohols may contain 8 to 10 carbon atoms, or combinations thereof. In still other embodiments, the anthranilate ester additive is derived from 2,4,6,8-tetramethyl-nonanol.

In some embodiments the anthranilate ester additive is derived from isatoic anhydride and an alcohol component consisting of 2,4,6,8-tetramethyl-nonanol, a mixture of linear alcohols where the alcohols may contain 8 to 10 carbon atoms, 2-ethylhexanol, or combinations thereof. In still other embodiments the additive is derived from isatoic anhydride and 2,4,6,8-tetramethyl-nonanol and/or a mixture of linear alcohols where the alcohols may contain 8 to 10 carbon atoms.

The anthranilate ester additives of the invention may be present in the lubricating compositions in amounts that deliver specific amounts of TBN, as described below. In other embodiments, used in combination with any of the embodiments described above, the additive may be present in a lubricating composition at 0.5, 1.0, 1.2 or 2.0 percent by weight or more. In still other embodiments, the additive is present within a range having a lower limit of 0.5, 1.0, 1.2 or 2.0 percent by weight and an upper limit of 3.0, 4.0, 4.5 or 5.0 percent by weight.

Additional Additives

In some embodiments, the compositions of the present invention contain one or more additional additives. A suitable additional additive is a detergent, where the detergent is different from the anthranilate ester additive described above.

Most conventional detergents used in the field of engine lubrication, unlike those of the present technology, obtain most or all of their basicity or TBN from the presence of basic metal-containing compounds (metal hydroxides, oxides, or carbonates, typically based on such metals as calcium, magnesium, or sodium). Such metallic overbased detergents, also referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are typically prepared by reacting an acidic material (typically an inorganic acid or lower carboxylic acid such as carbon dioxide) with a mixture of an acidic organic compound (also referred to as a substrate), a stoichiometric excess of a metal base, typically in a reaction medium of an one inert, organic solvent (e.g., mineral oil, naphtha, toluene, xylene) for the acidic organic substrate. Typically also a small amount of promoter such as a phenol or alcohol is present, and in some cases a small amount of water. The acidic organic substrate will normally have a sufficient number of carbon atoms to provide a degree of solubility in oil.

Such conventional overbased materials and their methods of preparation are well known to those skilled in the art. Patents describing techniques for making basic metallic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Salixarate detergents are described in U.S. Pat. No. 6,200,936.

Such conventional detergents may be used in the compositions of the present invention in combination with the anthranilate ester additives described above. However, in some embodiments the use of the anthranilate ester additives allows for a reduced need for such conventional nitrogen-containing additives without creating the detrimental effects they usually bring, for example increased seal degradation.

Additional conventional components may be used in preparing a lubricant according to the present invention, for instance, those additives typically employed in a crankcase lubricant. Crankcase lubricants may contain any or all of the following components hereinafter described.

Another additive is a dispersant. Dispersants are well known in the field of lubricants and include primarily what is known as ashless-type dispersants and polymeric dispersants. Ashless type dispersants are characterized by a polar group attached to a relatively high molecular weight hydrocarbon chain. Typical ashless dispersants include nitrogen-containing dispersants such as N-substituted long chain alkenyl succinimides, also known as succinimide dispersants. Succinimide dispersants are more fully described in U.S. Pat. Nos. 4,234,435 and 3,172,892. Another class of ashless dispersant is high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022. Another class of ashless dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Other dispersants include polymeric dispersant additives, which are generally hydrocarbon-based polymers which contain polar functionality to impart dispersancy characteristics to the polymer. Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403. The amount of dispersant in the present composition can typically be 1 to 10 weight percent, or 1.5 to 9.0 percent, or 2.0 to 8.0 percent, all expressed on an oil-free basis.

Another component is an antioxidant. Antioxidants encompass phenolic antioxidants, which may comprise a butyl substituted phenol containing 2 or 3 t-butyl groups. The para position may also be occupied by a hydrocarbyl group or a group bridging two aromatic rings. The latter antioxidants are described in greater detail in U.S. Pat. No. 6,559,105. Antioxidants also include aromatic amines, such as nonylated diphenylamine. Other antioxidants include sulfurized olefins, titanium compounds, and molybdenum compounds. U.S. Pat. No. 4,285,822, for instance, discloses lubricating oil compositions containing a molybdenum and sulfur containing composition. Typical amounts of antioxidants will, of course, depend on the specific antioxidant and its individual effectiveness, but illustrative total amounts can be 0.01 to 5, or 0.15 to 4.5, or 0.2 to 4 percent by weight. Additionally, more than one antioxidant may be present, and certain combinations of these can be synergistic in their combined overall effect.

Viscosity improvers (also sometimes referred to as viscosity index improvers or viscosity modifiers) may be included in the compositions of this invention. Viscosity improvers are usually polymers, including polyisobutenes, polymethacrylates (PMA) and polymethacrylic acid esters, diene polymers, polyalkylstyrenes, esterified styrene-maleic anhydride copolymers, hydrogenated alkenylarene-conjugated diene copolymers and polyolefins. PMA's are prepared from mixtures of methacrylate monomers having different alkyl groups. The alkyl groups may be either straight chain or branched chain groups containing from 1 to 18 carbon atoms. Most PMA's are viscosity modifiers as well as pour point depressants.

Multifunctional viscosity improvers, which also have dispersant and/or antioxidancy properties are known and may optionally be used. Dispersant viscosity modifiers (DVM) are one example of such multifunctional additives. DVM are typically prepared by copolymerizing a small amount of a nitrogen-containing monomer with alkyl methacrylates, resulting in an additive with some combination of dispersancy, viscosity modification, pour point depressancy and dispersancy. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity modifiers.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides; and phosphites. In certain embodiments a phosphorus antiwear agent may be present in an amount to deliver 0.01 to 0.2 or 0.015 to 0.15 or 0.02 to 0.1 or 0.025 to 0.08 percent by weight phosphorus. Often the antiwear agent is a zinc dialkyldithiophosphate (ZDP). For a typical ZDP, which may contain 11 percent P (calculated on an oil free basis), suitable amounts may include 0.09 to 0.82 percent by weight. Non-phosphorus-containing anti-wear agents include borate esters (including borated epoxides), dithiocarbamate compounds, molybdenum-containing compounds, and sulfurized olefins.

Other additives that may optionally be used in lubricating oils include pour point depressing agents, extreme pressure agents, color stabilizers and anti-foam agents. One or metal-containing detergents, as described above, may also be included.

The foregoing lubricating oil additives may be added directly to the base oil to form the lubricating oil composition. In one embodiment, however, one or more of the additives may be diluted with a substantially inert, normally liquid organic diluent such as mineral oil, synthetic oil, naphtha, alkylated (e.g., $C_{10}$-$C_{13}$ alkyl) benzene, toluene or xylene to form an additive concentrate. These concentrates may contain from about 1 to about 99 percent by weight, and in one embodiment from about 10 to 90 percent by weight of such diluent. The concentrates may be added to the base oil to form the lubricating oil composition.

In some embodiments the lubricating compositions of the present invention comprise at least one additive selected from the group consisting of non-phosphorus-containing anti-wear agents, ashless dispersants, antioxidants, friction modifiers, zinc dithiophosphates, and corrosion inhibitors.

The lubricating compositions of the present invention may have an overall TBN of greater than 6, a TBN of 7, 8, 9, 10 or greater. In still other embodiments the lubricating compositions of the present invention also have a sulfated ash content of less than 1.5, 1.3 or 1.0 percent by weight. In some embodiments, the TBN delivered by the anthranilate ester additive, alone or in combination with a conventional detergent additive, represents a TBN of at least 1, 2, 3, or 4 of the overall TBN of the lubricating composition. That is to say, the additive of the present invention may be used as a TBN booster and can be added to a lubricating composition to increase the overall TBN of that composition. In such embodiments, the anthranilate ester additives of the present invention may increase the TBN of the compositions to which they are added by 1, 2, 3, 4, 5 or more units. In some embodiments, the anthranilate ester additives are present in an amount sufficient to boost the TBN of the overall composition to which it is added by 1 to 6 units, 1 to 5 units, or 2 to 4 units.

The present invention provides a surprising ability to provide relatively high TBN while maintaining the low sulfated ash levels, and other limitations, required by increasingly stringent government regulations while at the same time protecting seal performance and compatibility.

The lubricating compositions of the present invention may have a nitrogen content of less than 0.4 or 0.3 percent by weight and/or a soap content of less than 5 or 3 percent by weight.

The lubricant described herein may be used to lubricate a mechanical device, by supplying the lubricant to the device, and in particular to the moving parts. The device may be an internal combustion engine (ICE), a driveline component (e.g., automatic or manual transmission, gear box, differential). The ICE that may be lubricated may include gasoline fueled engines, spark ignited engines, diesel engines, compression ignited engines, two-stroke cycle engines, four-stroke cycle engines, sump-lubricated engines, fuel-lubricated engines, natural gas-fueled engines, marine diesel engines, and stationary engines. The vehicles in which such ICE may be employed include automobiles, trucks, off-road vehicles, marine vehicles, motorcycles, all-terrain vehicles, and snowmobiles. In one embodiment, the ICE is a heavy duty diesel engine, which may include sump-lubricated, two- or four-stroke cycle engines, which are known to those skilled in the art.

Specific Embodiment

The invention will be further illustrated by the following examples, which sets forth particularly advantageous embodiments. While the examples are provided to illustrate the invention, they are not intended to limit it.

Anthranilate Ester Additives

Example A-1

Synthesis of 2-Amino-benzoic acid 2,4,6,8-tetramethyl-nonyl ester. A one liter, four necked, round bottom flask, equipped with an overhead stirrer, sub-surface gas inlet tube, thermowell, Dean-Stark trap, and Friedrick's condenser, is charged with 313.4 grams (1.56 moles) of 2,4,6,8-tetramethyl-nonan-1-ol. The flask is purged with nitrogen and warmed to 120 degrees C. 3.7 grams (46 mmoles) of a 50 percent by weight solution of NaOH in water is added drop-wise over 1 minute. The mixture is stirred at 120 degrees C. for 1 hour and water is collected in the Dean-Stark trap. 250 grams of isatoic anhydride (1.53 moles) is added portion-wise, supra-surface, over a period of 50 minutes. The mixture is stirred at 145 degrees C. for 6 hours. 9 grams of Fax-5 filter aid is added to the flask and stirred. The mixture is filtered and cooled to yield 456 grams of the product, in the form of a brown liquid. The product has a TBN, by ASTM D2896, of 150.

Example A-2

Synthesis of 2-Amino-benzoic acid decyl/octyl ester. A compound is prepared following the procedure of Example 1, except that 226.8 grams (1.56 moles) of Alfol 810™ l (a commercially available mixture of C8 to C10 linear alcohols) is used in place of the 2,4,6,8-tetramethyl-nonan-1-ol. The mixture is filtered and cooled to yield 368 grams of the product, in the form of a brown liquid. The product has a TBN, as measured by ASTM D2896, of 188.

Example A-3

Synthesis of 2-Amino-benzoic acid 2-ethyl-hexyl ester. A compound is prepared following the procedure of Example 1, except that 203.6 grams (1.56 moles) of 2-ethylhexanol is used in place of the 2,4,6,8-tetramethyl-nonan-1-ol. The mixture is filtered and cooled to yield 339 grams of the product, in the form of a brown liquid. The product has a TBN, by ASTM D2896, of 188.

Lubricating Compositions

The additives prepared in Examples A-1, A-2 and A-3 above are each blended into conventional fully formulated 15W-40 diesel lubricating oils (Examples 1-3). Several comparative examples are also prepared which are also conventional fully formulated 15W-40 diesel lubricating oils (Examples 4-12).

These lubricating oil compositions each contain less than 1 percent sulfated ash and typical amounts of conventional additives such as succinimide dispersants, over-based detergents, antioxidants and antiwear compounds such as ZDP's. All of the examples in the table below are formulated so that the amine TBN booster present provides about 4 mg KOH/g to the overall composition, except for Comparative Example 8 and Comparative Example 4. Comparative Example 8 provides a boost of about 2 mg KOH/g instead of 4 mg KOH/g to the overall composition. Comparative Example 4, the baseline example, contains no amine TBN booster and so provides no boost to the overall composition.

The formulation of each example is summarized below in Table 1, where all values are percents by weight.

TABLE 1

Lubricating Oil Composition Formulations

| Component | Ex 1 | Ex 2 | Ex 3 | Comp Ex 4[1] | Comp Ex 5[3] | Comp Ex 6 | Comp Ex 7[3] | Comp Ex 8 | Comp Ex 9 |
|---|---|---|---|---|---|---|---|---|---|
| Base Oil[2] | 74.1 | 74.7 | 74.7 | 76.8 | 76.9 | 68.3 | 74.4 | 76.0 | 73.9 |
| Example A-1 | 2.7 | — | — | — | — | — | — | — | — |
| Example A-2 | — | 2.1 | — | — | — | — | — | — | — |
| Example A-3 | — | — | 2.1 | — | — | — | — | — | — |
| Alkyl Amine[4] | — | — | — | — | 0.4 | — | — | — | — |
| Dispersant[5] | — | — | — | — | — | 8.5 | — | — | — |
| Amide Additive[6] | — | — | — | — | — | — | 2.86 | — | — |
| "Proton Sponge"[7] | — | — | — | — | — | — | — | 0.76 | — |
| Hydroxy Aniline[8] | — | — | — | — | — | — | — | — | 2.88 |

TABLE 1-continued

| Lubricating Oil Composition Formulations | | | | | | | | | |
|---|---|---|---|---|---|---|---|---|---|
| Component | Ex 1 | Ex 2 | Ex 3 | Comp Ex 4[1] | Comp Ex 5[3] | Comp Ex 6 | Comp Ex 7[3] | Comp Ex 8 | Comp Ex 9 |
| OCP VM[9] | 6.0 | 6.0 | 6.0 | 6.0 | 5.5 | 6.0 | 5.5 | 6.0 | 6.0 |
| Additional Additives[10] | 17.2 | 17.2 | 17.2 | 17.2 | 17.2 | 17.2 | 17.2 | 17.2 | 17.2 |

[1]Comparative Example 4 contains no amine TBN booster and is a baseline sample.
[2]The base oil used in these examples, unless otherwise noted, is a 97:3 weight ratio mixture of 220N and 600N Group II base oils. No matter what base oil combinations are used, all examples in this table are 15W-40 CJ-4 capable lubricants in Group II basestocks and are comparable to one another with regards to seal compatibility.
[3]Comparative Examples 5 and 7 use a 77:23 weight ratio mixture of 260N and 130N Group II base oils and, as noted, are 15W-40 CJ-4 capable lubricants in Group II basestocks.
[4]Comparative Example 5 contains a typical alkyl amine, 1,4-diazabicycle(2,2,2)octane in place of the anthranilate esters used in Examples 1-3 as the amine TBN booster.
[5]Comparative Example 6 contains a typical succinimide dispersant containing a polyamine headgroup, thus acting as an amine TBN booster. This dispersant is in addition to the typical amount of dispersant supplied by the additive package to each of the examples.
[6]Comparative Example 7 contains an anthranilic acid amide derived from isatoic anhydride and tridecyloxypropyl amine. This compound has an amide group attached to the ring.
[7]Comparative Example 8 contains 1,8-bis(dimethylamino)naphthalene, which is commonly referred to by the trade name "Proton Sponge".
[8]Comparative Example 9 contains a hydroxy aniline, which may also be described as an aminophenol. The additive here has an alkyl group containing 15 to 18 carbon atoms.
[9]All examples contain the same conventional OCP (olefin copolymer) viscosity modifier at the amounts shown in the table.
[10]All examples in the table contain identical amounts of certain conventional additives, grouped here collectively for convenience. The additional additives in these examples are all conventional additives typical for a 15W-40 CJ-4 capable lubricant.

Seal Compatibility Testing

The lubricating oil compositions summarized in Table 1 above are tested for seals performance using a standard seals compatibility test. In the test, a sample of fluoroelastomeric seal material is exposed to the lubricating oil composition for a period of time at elevated temperatures. The seal material is tested both before and after the exposure to determine any impact the exposure had on its physical properties, particularly those related to good seal performance and durability. Specifically, the tensile strength and rupture elongation strength of the seal material is measured before and after the exposure. A larger absolute percent change in either of these quantities is an indication of greater seal material degradation and so worse performance. In other words, the smaller the change, the less seal degradation that has occurred, and so the more compatible the material is with the seal material. All samples are also tested to determine TBN, using ASTM procedure D2896, and their sulfated ash levels, using ASTM procedure D874. All testing was completed with Viton™ seal material and the results are summarized in Table 2 below.

TABLE 2

| Seal Compatibility Testing Results | | | | | |
|---|---|---|---|---|---|
| Lubricating Oil Composition | Amine TBN Booster Present | TNB D2896 | % Sulfated Ash D874 | % Change in Tensile Strength | % Change in Rupture Elongation Strength |
| Example 1 | Ex A-1 | 12.2 | 0.95 | −56.0 | −53.3 |
| Example 2 | Ex A-2 | 12.3 | 0.94 | −60.4 | −58.3 |
| Example 3 | Ex A-3 | 12.4 | 0.94 | −60.7 | −62.2 |
| Comparative Example 4 | None (Baseline) | 8.4 | 0.93 | −60.2 | −57.7 |
| Comparative Example 5 | Alkyl Amine | 12.1 | 0.96 | −87.5 | −99.7 |
| Comparative Example 6 | Succinimide Dispersant | 12.3 | 0.96 | −76.5 | −70.7 |
| Comparative Example 7 | Amide Additive | 12.3 | 0.93 | −73.7 | −74.3 |

TABLE 2-continued

| Seal Compatibility Testing Results | | | | | |
|---|---|---|---|---|---|
| Lubricating Oil Composition | Amine TBN Booster Present | TNB D2896 | % Sulfated Ash D874 | % Change in Tensile Strength | % Change in Rupture Elongation Strength |
| Comparative Example 8 | "Proton Sponge" | 10.2 | 0.93 | −88.2 | −99.9 |
| Comparative Example 9 | Hydroxy Aniline | 12.1 | 0.97 | −73.2 | −69.0 |

The results show that all compositions tested had about the same starting TBN and received a boost, from the amine additive used in each, of about 4 mg KOH/g, except for Comparative Example 4, the baseline with no amine TBN booster, and Comparative Example 8, which received a boost of about 2 mg KOH/g.

The results show that Examples 1-3 have comparable seal compatibility compared to the Example 4 baseline. Comparative Examples 5-9 show that various amine TBN boosters, other than the anthranilate ester additives of the present invention, may also supply TBN to a lubricating composition. However none of these examples can do so without compromising seal compatibility, as demonstrated by the results. In contrast, Examples 1-3 provide the same, or greater, TBN boost while maintaining seal compatibility.

Additional Lubricating Compositions

An additional set of lubricating compositions are prepared in order to further demonstrate the benefits of the present invention. The formulations of these examples are summarized in Table 3, where all values are percents by weight.

TABLE 3

Additional Composition Formulations - Inventive Examples

| Component | 220N Base Oil | Tri-decane Amine | Tri-octyl Amine | Alkyl Imidazoline[2] | Alkyl Amine A[3] | Alkyl Amine B[4] | Succinimide Dispersant[5] | Oleyl Amine | Example A-1 | Example A-2 | Additional Additives[1] |
|---|---|---|---|---|---|---|---|---|---|---|---|
| Comp Example 10 | 79.8 | — | — | — | — | — | — | — | — | — | 20.2 |
| Example 11 | 78.5 | — | — | — | — | — | — | — | 1.34 | — | 20.2 |
| Example 12 | 78.6 | — | — | — | — | — | — | — | — | 1.23 | 20.2 |
| Comp Example 13 | 79.1 | 0.68 | — | — | — | — | — | — | — | — | 20.2 |
| Comp Example 14 | 78.4 | 1.36 | — | — | — | — | — | — | — | — | 20.2 |
| Comp Example 15 | 78.5 | — | 1.26 | — | — | — | — | — | — | — | 20.2 |
| Comp Example 16 | 77.3 | — | 2.52 | — | — | — | — | — | — | — | 20.2 |
| Comp Example 17 | 77.6 | — | — | 2.22 | — | — | — | — | — | — | 20.2 |
| Comp Example 18 | 79.0 | — | — | — | 0.85 | — | — | — | — | — | 20.2 |
| Comp Example 19 | 78.6 | — | — | — | — | 1.25 | — | — | — | — | 20.2 |
| Comp Example 20 | 77.8 | — | — | — | — | — | 2.00 | — | — | — | 20.2 |
| Comp Example 21 | 78.4 | 0.34 | — | 1.11 | — | — | — | — | — | — | 20.2 |
| Comp Example 22 | 76.9 | 0.68 | — | 2.22 | — | — | — | — | — | — | 20.2 |
| Comp Example 23 | 78.5 | 0.34 | — | — | — | — | 1.00 | — | — | — | 20.2 |
| Comp Example 24 | 78.1 | 0.68 | — | — | — | — | 1.00 | — | — | — | 20.2 |
| Comp Example 25 | 78.8 | — | — | — | — | — | — | 1.00 | — | — | 20.2 |

[1]All of the examples contain identical amounts of certain additives, including a dispersant-inhibitor package, a viscosity modifier, and a pour point depressant. These additives are grouped here collectively for convenience.
[2]The alkyl imidazoline is derived from isostearic acid and a polyamine.
[3]Alkyl Amine A is derived from tallow amine and formaldehyde.
[4]Alkyl Amine B is a commercially available alkyl amine sold as Ethomeen T/12 ™.
[5]Comparative Examples 20, 23 and 24 contain a typical succinimide dispersant containing a polyamine headgroup, thus acting as an amine TBN booster. This dispersant is in addition to the typical amount of dispersant supplied by the additive package to each of the examples.

All of the examples in Table 3, with the exception of Comparative Example 10, which contains no booster, are formulated so that the amine TBN booster provides about 2 to 4 mg KOH/g to the composition. In Examples 11 and 12 these boosters are the anthranilate esters described above while in the Comparative Examples 13-25 the boosters are other amine-containing additives.

The lubricating oil compositions summarized in Table 3 above are tested for seals performance using the seal test described above, as well as the same tests for TBN and sulfated ash. Results of this testing is summarized in Table 4.

TABLE 4

Seal Compatibility Testing Results

| Lubricating Oil Composition | TBN D2896 | % Sulfated Ash D874 | % Change in Tensile Strength | % Change in Rupture Elongation Strength |
|---|---|---|---|---|
| Comp Example 10 | 7.8 | 0.98 | −31.3 | −34.0 |
| Example 11 | 9.8 | 1.07 | −30.4 | −31.2 |
| Example 12 | 9.7 | 1.00 | −33.3 | −31.1 |
| Comp Example 13 | 9.9 | 0.95 | −41.4 | −67.5 |
| Comp Example 14 | 11.5 | 0.98 | −47.9 | −76.0 |
| Comp Example 15 | 9.6 | 0.98 | −64.1 | −78.1 |
| Comp Example 16 | 11.7 | 0.99 | −69.9 | −84.8 |
| Comp Example 17 | 9.5 | 0.99 | −59.5 | −48.4 |
| Comp Example 18 | 10.1 | 1.00 | −76.0 | −68.3 |
| Comp Example 19 | 9.7 | 0.98 | −66.2 | −61.8 |
| Comp Example 20 | 9.6 | 0.98 | −59.2 | −53.1 |
| Comp Example 21 | 9.2 | 0.97 | −62.4 | −63.5 |
| Comp Example 22 | 11.3 | 1.06 | −72.6 | −73.9 |
| Comp Example 23 | 9.3 | 0.99 | −66.2 | −69.8 |
| Comp Example 24 | 10.1 | 0.99 | −71.9 | −78.8 |
| Comp Example 25 | 9.8 | 1.00 | −76.0 | −86.2 |

The results show that Examples 11 and 12 have comparable seal compatibility compared to the Example 10 baseline. Comparative Examples 13-25 show that typical amine TBN boosters can supply the same relative amount of TBN as the anthranilate ester additives of the present invention, however these formulations show poor seal compatibility.

All of the results above show that the present invention provides a means of supplying zero ash TBN to a lubricating oil composition by using an ashless amine TBN-delivering additive. The present invention accomplishes this surprisingly without the harm to seal compatibility expected from the use of many amine-containing TBN-delivering additives.

In this specification the terms "hydrocarbyl substituent" or "hydrocarbyl group," as used herein are used in its ordinary sense, which is well-known to those skilled in the art. Specifically, it refers to a group primarily composed of carbon and hydrogen atoms and is attached to the remainder of the molecule through a carbon atom and does not exclude the presence of other atoms or groups in a proportion insufficient to detract from the molecule having a predominantly hydrocarbon character. In general, no more than two, preferably no more than one, non-hydrocarbon substituent will be present for every ten carbon atoms in the hydrocarbyl group; typically, there will be no non-hydrocarbon substituents in the hydrocarbyl group. A more detailed definition of the terms "hydrocarbyl substituent" or "hydrocarbyl group," is described in U.S. Pat. No. 6,583,092.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, all percent values listed herein are on a weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method of lubricating a 2 or 4-stroke cycle internal combustion engine, comprising supplying to said engine a lubricating composition comprising (a) an oil of lubricating viscosity and (b) an additive of formula (I)

(I)

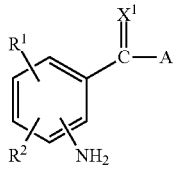

wherein $X^1$ is oxygen or sulfur; A is $—X^2—R^3$ or $—R^3$ where $X^2$ is oxygen or sulfur and $R^3$ is a hydrocarbyl group containing at least 12 carbon atoms; $R^1$ and $R^2$ are each independently hydrogen or a hydrocarbon group, or where $R^1$ and $R^2$ together form a hydrocarbyl ring, and (c) a metal-containing detergent which delivers TBN to the lubricating composition;

wherein the sulfated ash content of the lubricating composition is 1% or less, the TBN of the lubricating composition is at least 6, and the additive is present in an amount to boost the TBN of the lubricating composition to which it is added from about 1 to about 5 units.

2. The method of claim 1 wherein (a), the oil of lubricating viscosity, has at least one property selected from the group consisting of: (i) a phosphorus content below 0.2% by weight, and (ii) a sulfur content below 1% by weight.

3. The method of claim 1 wherein (b) is represented by formula (II)

(II)

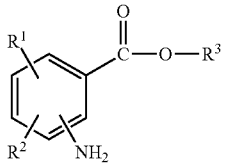

wherein $R^1$ and $R^2$ are each independently hydrogen or a hydrocarbon group, or where $R^1$ and $R^2$ together form a hydrocarbyl ring, and wherein $R^3$ is a hydrocarbon group.

4. The method of claim 1 wherein (b) is represented by formula (III)

(III)

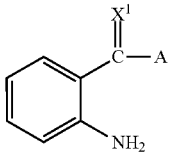

wherein $X^1$ is oxygen or sulfur; A is $—X^2—R^3$ or $—R^3$ where $X^2$ is oxygen or sulfur and $R^3$ is a hydrocarbyl group.

5. The method of claim 1 wherein $R^3$ is: (i) a hydrocarbyl group containing at least one branch point; (ii) a fully saturated alkyl group; or (iii) combinations thereof.

6. The method composition of claim 1 wherein: (i) the nitrogen content of the composition is less than 0.4 percent by weight, (ii) the soap content of the composition is less than 5 percent by weight, or (iii) combinations thereof.

7. The method claim 1 wherein component (b) is derived from isatoic anhydride and an alcohol.

8. The method of claim 1 further comprising at least one additive selected from the group consisting of non-phosphorus-containing anti-wear agents, ashless dispersants, antioxidants, friction modifiers, zinc dithiophosphates, dispersant viscosity modifiers and corrosion inhibitors.

9. An engine oil lubricating composition comprising:

(a) an oil of lubricating viscosity;

(b) an additive of formula (I)

(I)

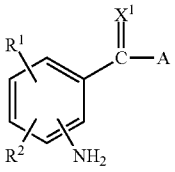

wherein:

$X^1$ is oxygen or sulfur; A is $—X^2—R^3$ or $—R^3$ where $X^2$ is oxygen or sulfur and $R^3$ is a hydrocarbyl group containing at least 12 carbon atoms; $R^1$ and $R^2$ are each independently hydrogen or a hydrocarbon group, or where $R^1$ and $R^2$ together form a hydrocarbyl ring; and (c) a metal-containing detergent which delivers TBN to the lubricating composition;

wherein the sulfated ash content of the lubricating composition is 1% or less, the TBN of the lubricating composition is at least 6, and the additive is present in an amount to boost the TBN of the lubricating composition to which it is added from about 1 to about 5 units;

wherein the engine comprises a two or four stroke cycle internal combustion engine.

* * * * *